US005797578A

United States Patent [19]

Graffeo et al.

[11] Patent Number: 5,797,578

[45] Date of Patent: Aug. 25, 1998

[54] COLLAPSIBLE ARTICLE SUPPORT

[76] Inventors: Robert Graffeo, 1150 Vollkommer Pl., N. Bellmore, N.Y. 11710; David Pickow, 141 Ocean Ave., Massapequa Park, N.Y. 11762

[21] Appl. No.: 790,389

[22] Filed: Jan. 29, 1997

[51] Int. Cl.[6] ..... A47G 1/24

[52] U.S. Cl. ..... 248/453; 248/456; 248/460

[58] Field of Search ..... 248/453, 452, 248/451, 449, 456, 460

[56] References Cited

U.S. PATENT DOCUMENTS

| | | | |
|---|---|---|---|
| 396,362 | 1/1889 | Marks . | |
| 498,578 | 5/1893 | Schmirk . | |
| 1,081,185 | 12/1913 | Aaron . | |
| 1,216,048 | 2/1917 | Bancroft . | |
| 1,923,351 | 8/1933 | Woodley | 248/456 |
| 2,083,839 | 6/1937 | Grieve . | |
| 2,219,091 | 10/1940 | Henderson | 248/452 |
| 2,501,019 | 3/1950 | Attick . | |
| 2,538,318 | 1/1951 | Mitchell . | |
| 2,912,203 | 11/1959 | Townsend . | |
| 3,140,558 | 7/1964 | Cassidy . | |
| 3,562,796 | 2/1971 | Jacobson . | |
| 3,715,097 | 2/1973 | Kalajian | 248/444 |
| 3,952,989 | 4/1976 | Bannister Hatcher | 248/453 |
| 3,954,246 | 5/1976 | Sparkman | 248/453 |
| 4,036,465 | 7/1977 | Kellner | 248/463 |
| 4,378,102 | 3/1983 | Portis, Jr. et al. | 248/460 |
| 4,436,271 | 3/1984 | Manso | 248/460 |
| 4,466,593 | 8/1984 | Odenath | 248/455 |
| 4,518,140 | 5/1985 | Ferranto | 248/456 |
| 4,618,119 | 10/1986 | Powell | 248/456 |
| 4,832,303 | 5/1989 | Myeeo | 248/444.1 |
| 4,886,231 | 12/1989 | Doerksen | 248/455 |
| 5,035,393 | 7/1991 | Menaged | 248/456 |
| 5,102,088 | 4/1992 | Ramani | 248/460 |
| 5,106,048 | 4/1992 | Lebar et al. | 248/460 |
| 5,170,983 | 12/1992 | Stewart | 248/558 |
| 5,316,256 | 5/1994 | Siebenaler et al. | 248/453 |
| 5,433,415 | 7/1995 | Samson et al. | 248/448 |
| 5,478,040 | 12/1995 | Rellinger et al. | 248/448 |
| 5,516,072 | 5/1996 | Shinno | 248/460 |
| 5,639,053 | 6/1997 | Dmitriev | 248/460 |

*Primary Examiner*—Ramon O. Ramirez
*Attorney, Agent, or Firm*—Dilworth & Barrese

[57] ABSTRACT

An apparatus for supporting a reading article in an open position includes a base member having a base supporting surface for supporting a reading article along a lower edge of the reading article when in an open position and being appropriately dimensioned to accommodate reading articles of varying sizes and a backing member operatively connected to the base member and extending at least in a vertical direction relative to the base member and having a backing support surface for supporting the reading article. The apparatus is adjustable along several axes, i.e., along both horizontal and vertical planes, to selectively position the reading material at a desired reading level. The angular orientation of the article is also adjustable. The support apparatus is capable of supporting books of varying sizes including oversized reference books or the like. The apparatus is also collapsible for ease of transport and/or storage.

28 Claims, 8 Drawing Sheets

COLLAPSIBLE ARTICLE SUPPORT

BACKGROUND OF THE INVENTION

1. Field of the Invention

The present invention relates generally to an apparatus for supporting a reading article in an open reading position, and, more particularly, to an adjustable apparatus permitting a variety of adjusting motions so as to ensure proper angle and line of vision of the reading article with respect to the reader. Moreover, the present invention is directed to a portable support apparatus capable of assuming a collapsed condition thereby facilitating storage and transport thereof.

2. Description of Related Art

Many people, particularly students, office workers, etc. complain of neck pain while reading in a sitting position. This pain is caused by poor posture due to a forward flexed head position necessary to read the material lying on the table or desk top. Forward flexion of the head at angles greater than 20 degrees lead to pain and fatigue of the posterior neck muscles. Prolonged awkward postures such as this is a causative factor of cumulative trauma disorder. Although sometimes referred to as repetitive motion injuries, cumulative trauma disorders involve factors such as repetitive motions, mechanism stress, and improper postures among others. These factors require more muscle effort, allowing less recovery time which can lead to fatigue and scarring and weakening of structures such as ligaments, disks, muscles, bones, nerves, blood vessels, and tendons. If such injuries are ignored, chronic pain or disability may often be the end result.

It is known in the art to utilize reading article supports or stands to orient an article in an open reading position. See, e.g., U.S. Pat. Nos. 2,501,019 to Attick; 3,952,989 to Bannister Hatcher and 4,886,231 to Doerksen. Although not specifically intended to minimize the degree of flexion of the head, these devices inherently provide some relief to the reader in that the article is supported in a general upright position. Consequently, the line of sight of the reader is improved, i.e., more horizontally oriented as compared to the line of sight defined with the reading article lying flat on, for example, a table top.

Although known prior art devices have proven to be generally effective in maintaining reading material in an open upright position, these devices have their own particular shortcomings which detract from their usefulness. For example, such devices are limited with respect to their adjustability along several axes, i.e., along a horizontal and/or vertical plane, and with respect to the adjustability of the angular orientation of the reading article. In addition, the devices are generally complicated requiring a number of component parts, thus increasing the difficulty of operation. Moreover, known devices are not particularly adapted to handle reading articles of varying sizes, particularly, large or oversized reference books.

SUMMARY OF THE INVENTION

Accordingly, the present invention is directed to an apparatus which addresses the disadvantages of the prior art. Generally speaking, the invention is directed to an apparatus for supporting a reading article in an open position. The apparatus includes a base member having a base supporting surface for supporting a reading article along a lower edge of the reading article when in an open position and being appropriately dimensioned to accommodate reading articles of varying sizes, and a backing member operatively connected to the base member and extending at least in a vertical direction relative to the base member and having a backing support surface for supporting the reading article. The base member is foldable preferably along a hinge to a closed position thereof to be in superposed relation with respect to the backing member. At least one leg member may be associated with one of the base member and the backing member. The one leg member is selectively adjustable to at least adjust the vertical positioning of the base member to thereby at least adjust the vertical position of the reading article. Means may be provided for releasably securing the one leg member at a plurality of predetermined positions with respect to the base member. Preferably, the one leg member is telescopically received within a correspondingly dimensioned bore defined within the backing member.

At least one brace member may be connected to the backing member. The one brace member is movable to selectively adjust the angular orientation of the backing member. A locking brace may be provided and connected to either the base member or the backing member. The locking brace is engagable by the brace member to selectively position the backing member at a desired angular orientation. Preferably, at least two brace members are provided whereby a first of the brace members is connected to an upper portion of the backing member and a second of the brace members is connected to the first brace member and engagable with the locking brace. The first and second brace members are preferably adapted for relative movement to adjust the effective length of the two members thereby providing another manner to adjust the angular orientation of the backing member. A securing member may be associated with the brace members and is movable to secure the relative positioning of the first and second brace members.

The apparatus may further include at least one lower article clamp associated with the base member and moveable in a lateral direction with respect to the backing member to releasably engage a lower portion of the reading article. A locking member for securing the lower article clamp at a plurality of predetermined lateral positions may be provided. Preferably, the lower article clamp is rotatable about an axis of rotation to assume a closed position in general superposed relation with respect to the base member.

The apparatus may further include an upper article clamp associated with the backing member and dimensioned and configured to releasably engage an upper portion of the reading article. Preferably, at least the vertical positioning of the upper article clamp is adjustable relative to the backing member to accommodate reading articles of varying heights.

In an alternate embodiment, the apparatus for supporting a reading article includes a base member having a base supporting surface for supporting a reading article along a lower edge of the reading article when in an open position, a backing member operatively connected to the base member and extending at least in a vertical direction relative to the base member and having a backing support surface for supporting the reading article, and at least one leg member associated with one of the base member and the backing member. The one leg member is selectively adjustable to at least adjust the vertical positioning of the base member to thereby at least adjust the vertical positioning of the reading article.

In another alternate embodiment, the apparatus for supporting a reading article includes a base member having a base supporting surface for supporting a reading article along a lower edge of the reading article when in an open position, a backing member operatively connected to the base member and extending at least in a vertical direction relative to the base member and having a backing support surface for supporting the reading article, and an upper article clamp associated with the backing member to releasably engage an upper portion of the reading article. Preferably, at least the vertical positioning of the upper article clamp is adjustable to accommodate reading articles of varying heights.

BRIEF DESCRIPTION OF THE DRAWINGS

Preferred embodiments of the disclosure are described herein with reference to the drawings wherein.

DETAILED DESCRIPTION OF THE PREFERRED EMBODIMENTS

Figure 1:
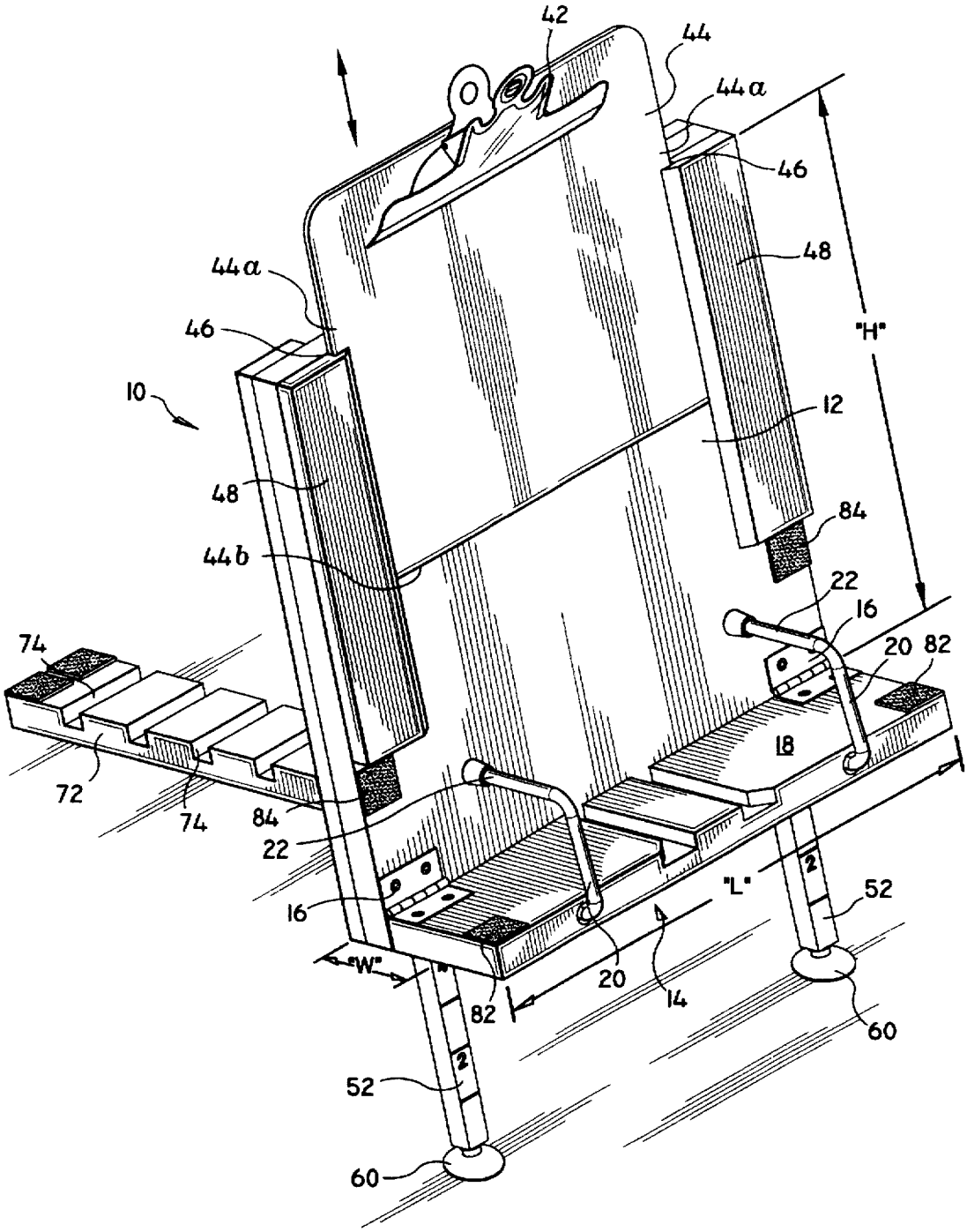
FIGS. 1–2 are frontal and rear perspective views of the apparatus constructed in accordance with the principles of the present invention.
Figure 2:
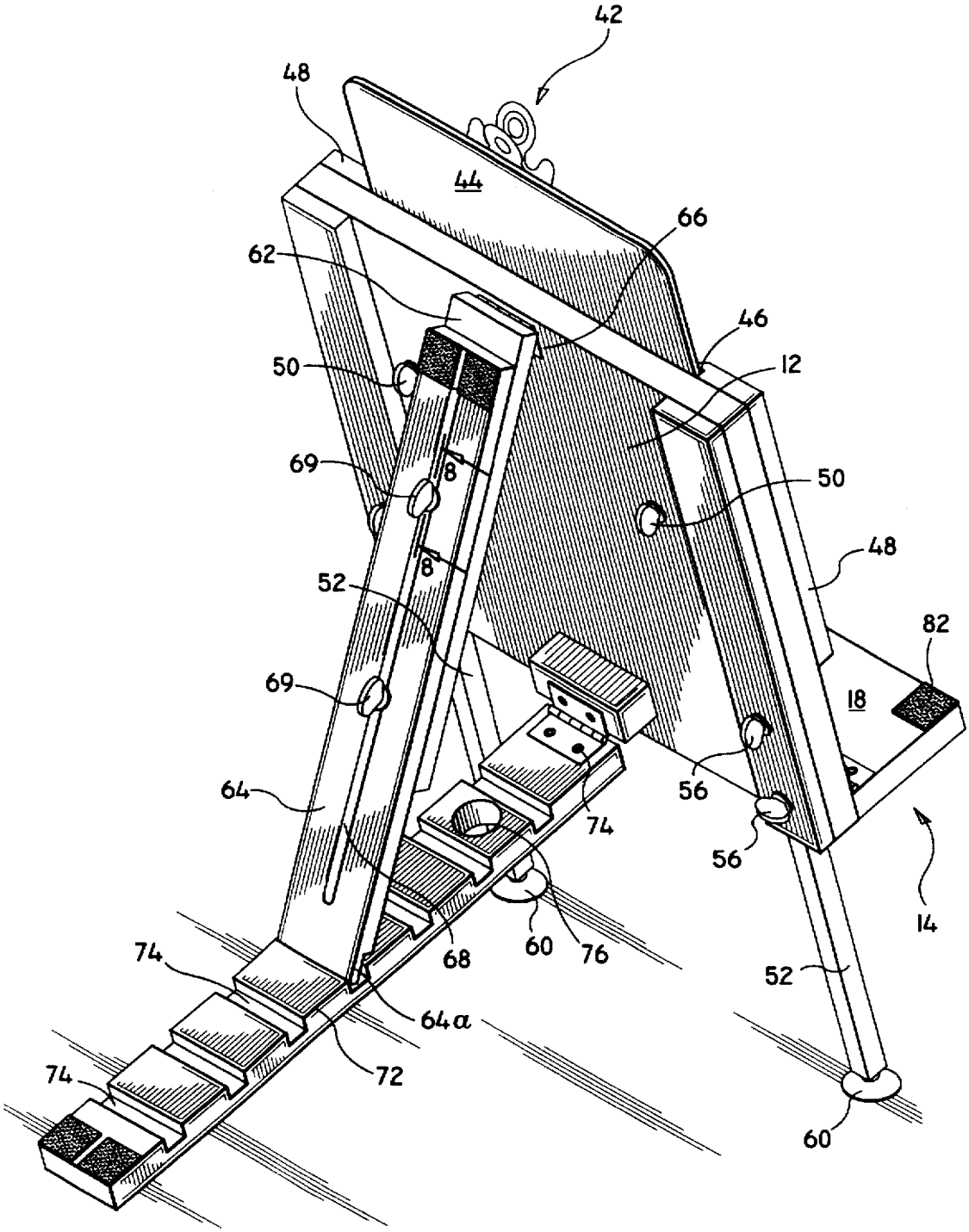
Figure 3:
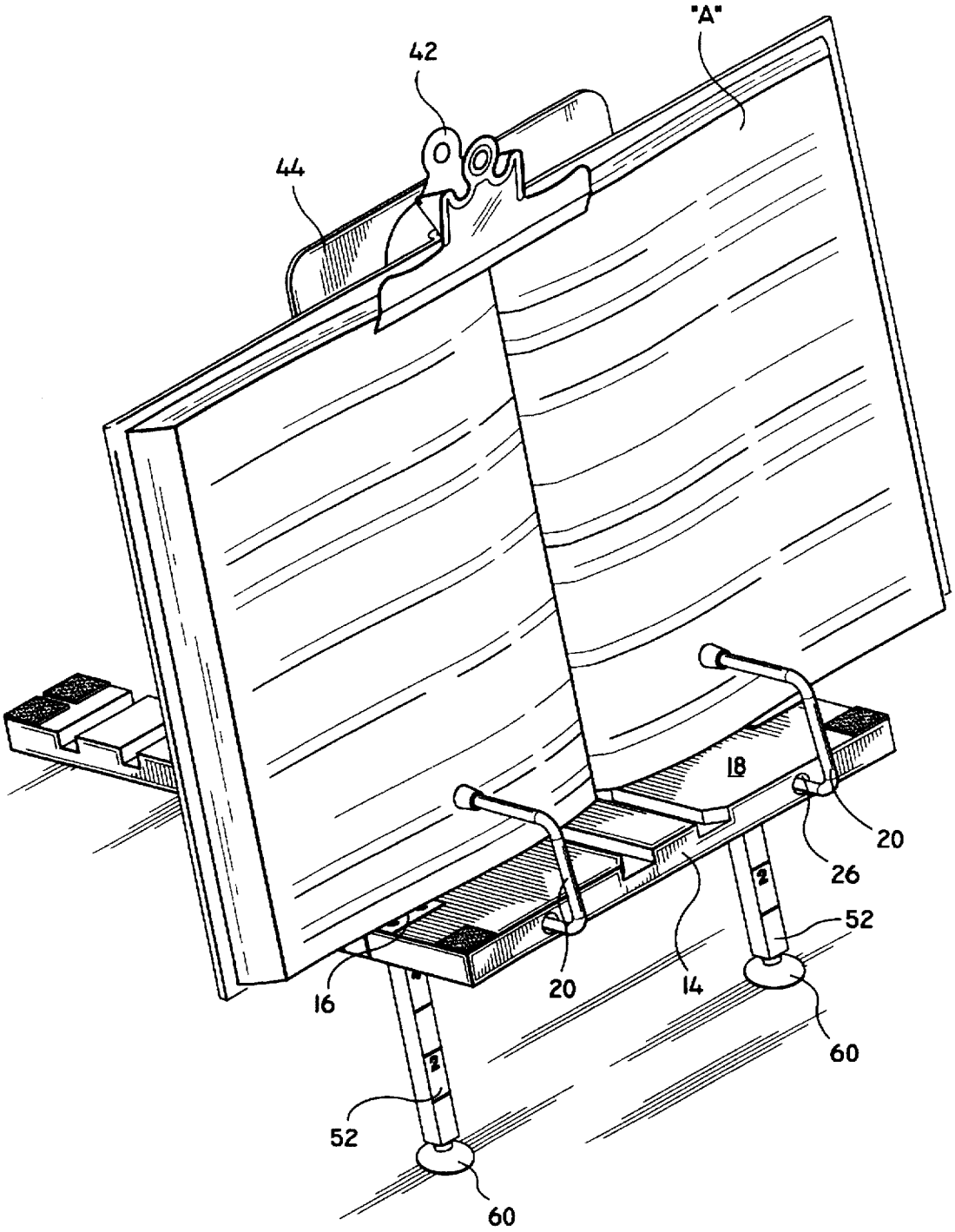
FIG. 3 is a perspective view similar to the view of FIG. 1 illustrating a reading article supported by the apparatus.

Referring now in detail in which like reference numerals identify similar or like elements throughout the several views, FIGS. 1–3 illustrate, in perspective, the apparatus 10 constructed in accordance with the principles of the present invention. Apparatus 10 is intended to support a reading material or article in an open position and, as will be further appreciated from the description provided hereinbelow, is readily adaptable to accommodate articles ranging in a variety of sizes. Apparatus 10 is also adjustable with respect to its vertical, horizontal and angular positions to ensure reader comfort and to satisfy ergonomic concerns. Moreover, apparatus 10 is readily collapsible to be positioned in a brief case, book bag, etc. . . . for ease of transport.

Apparatus 10 includes backing member 12 and base member 14 connected to the backing member 12 through first and second hinge elements 16. Base member 14 defines base supporting surface 18 which is intended to support the lower edges of reading article A (e.g., a book, magazine, journal, etc. . . . ) (FIG. 3). Base supporting surface 18 is advantageously dimensioned to accommodate reading articles of varying sizes and thicknesses and preferably ranges in length "L" from about 9 inches to about 18 inches, more preferably 12 inches and in width "W" from about 1 inch to about 6 inches, more preferably 3 inches. Base supporting surface 18 defines a general horizontal plane when in the open position as depicted in FIG. 1.

Backing member 12 defines a backing support surface 12*a* extending in a general vertical direction when in the open position. Backing member 12 preferably ranges in height "H" from about 10 inches to about 20 inches, more preferably about 14 inches. Further details of backing member 12 will be discussed in more detail hereinbelow.

Figure 4:
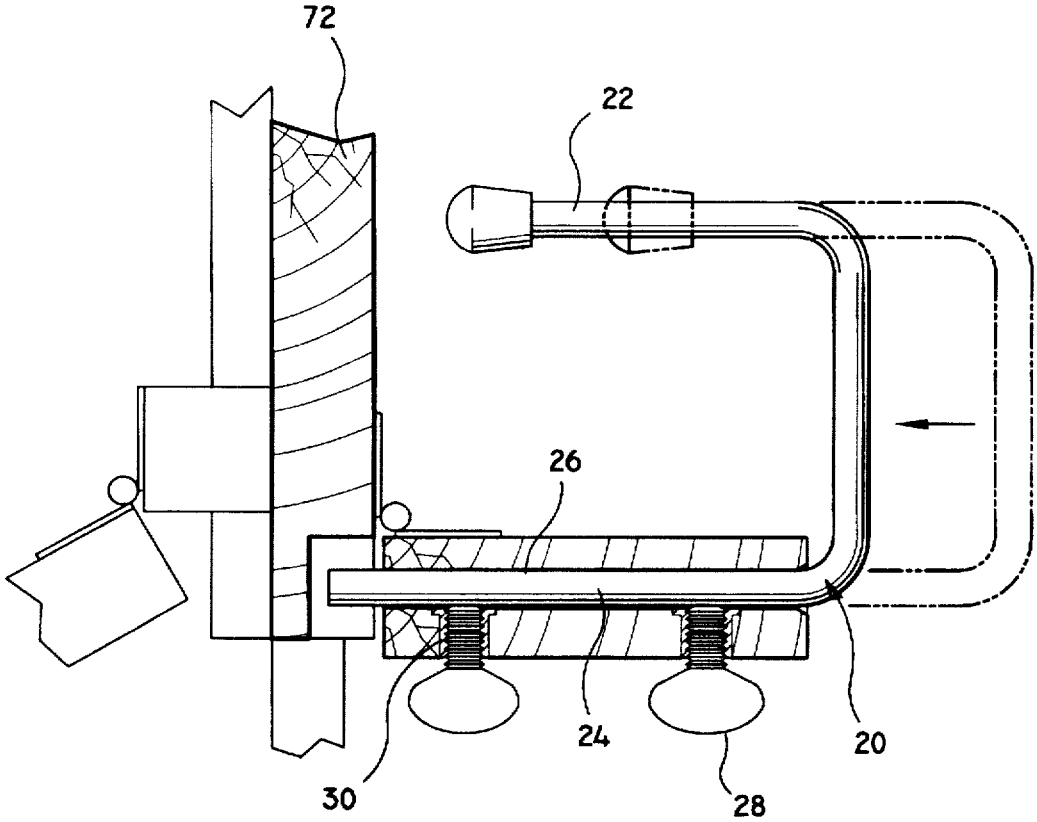
FIG. 4 is a cross-sectional view of a lower article clamp for releasably engaging a lower portion of the reading material.

With reference now to FIG. 4, in conjunction with FIG. 1, first and second article clamps 20 are mounted to base member 14. Article clamps 20 are intended to releasably engage the lower portion of the reading article "A" to maintain the article in the open position depicted in FIG. 3. Article clamps 20 are generally U-shaped as shown and possess an article engaging segment 22 which engages the pages of the article support "A". The remote end of each article engaging segment 22 has an engaging knob 23 which directly contacts the pages of the reading article. Knobs 23 are preferably fabricated from a suitable rubber or polymeric material to enhance frictional engagement with the pages of the article "A". In a preferred mounting arrangement of article clamp 20, a mounting segment 24 of each article clamp 20 is received within a correspondingly dimensioned lateral or transverse bore 26 defined in base member 14 to mount the article clamp 20 to the apparatus. Each article clamp 20 is laterally movable (as shown in phantom in FIG. 4) relative to backing member 12 as provided by translation of mounting segment 24 through bore 26, to accommodate books of varying thicknesses. A pair of winged locking bolts 28 may be provided to engage mounting segments 24 of article clamp 20 to secure each clamp at a desired lateral position. Locking bolts 28 are received within threaded bores 30 extending from the lower surface of base member 14. It is also envisioned that one article clamp 20 (instead of two) may be utilized to accomplish the objectives of the present invention.

Figure 5A:
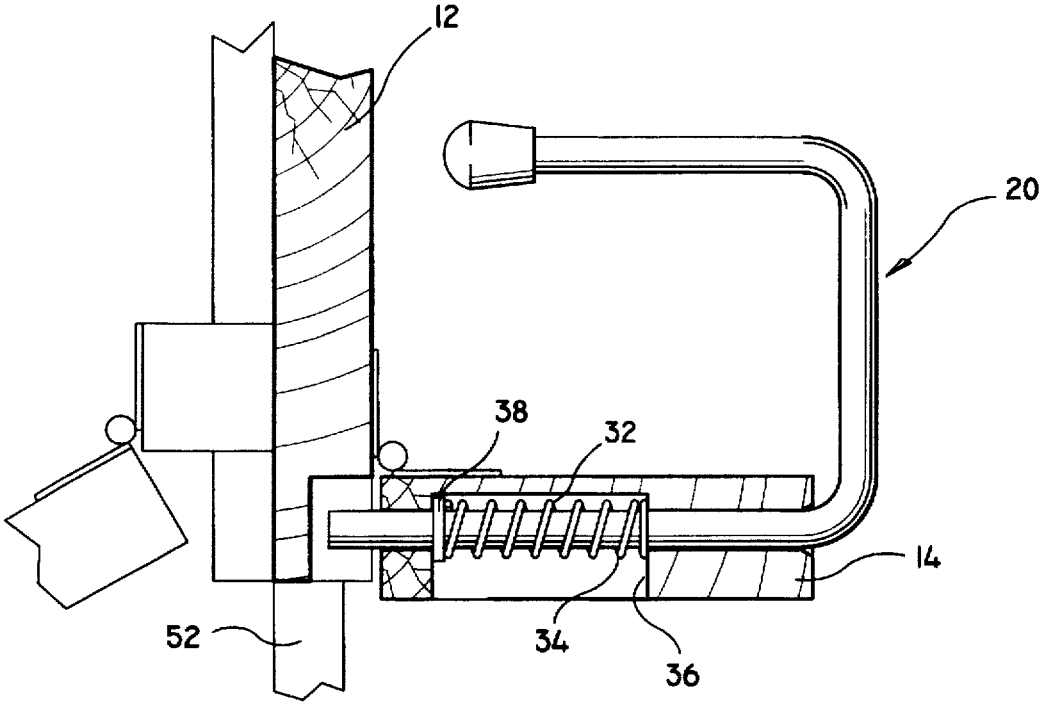
FIGS. 5A–5B are cross-sectional views similar to the view of FIG. 4 illustrating the lower article clamp biased inwardly by a spring mechanism.
Figure 5B:
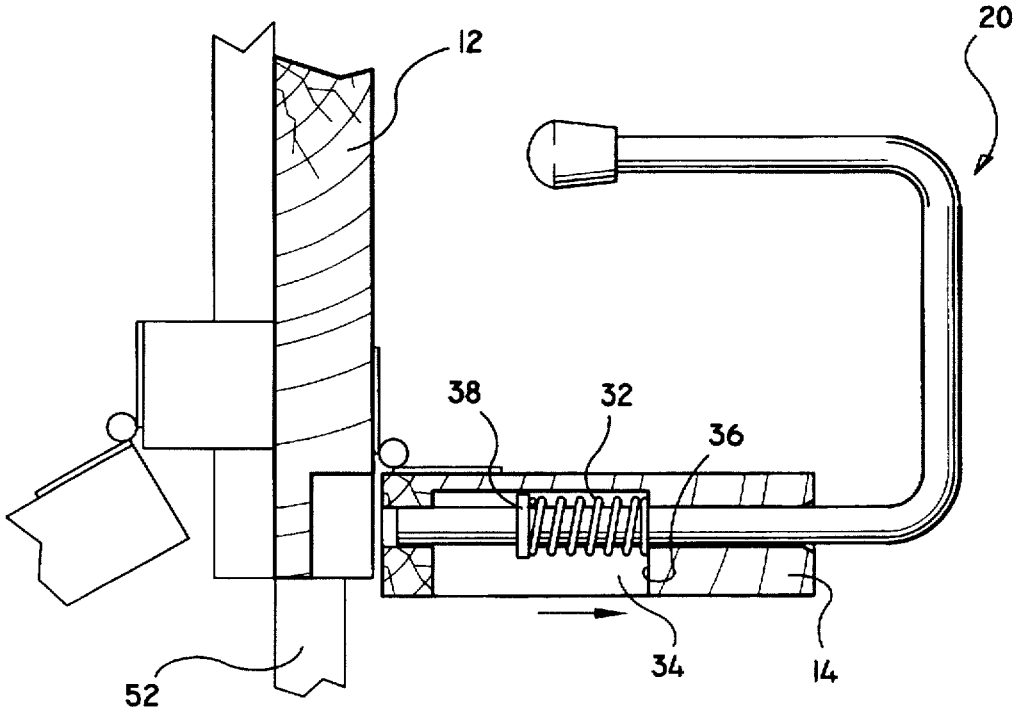

FIGS. 5A–5B illustrate an alternate embodiment of the article clamps 20. In accordance with this embodiment, each article clamp 20 is normally biased toward backing member 12 by coil spring 32. In particular, coil spring 32 is mounted within a recessed section 34 of base member 14 and engages at one end support surface 36 of base member 14 and at its other end spring collar 38 of the article clamp 20. Spring collar 38 is fixed about the outer surface of mounting segment 24 of article clamp 20 or may be integrally formed therewith. With this arrangement, article clamp 20 is normally biased in a direction toward backing member 12 thus causing engaging segment 22 and knob 23 to engage the reading article "A". FIG. SB illustrates coil spring 32 in a compressed condition corresponding to a position of article clamp 20 when in engagement with the reading article "A".

Figure 6:
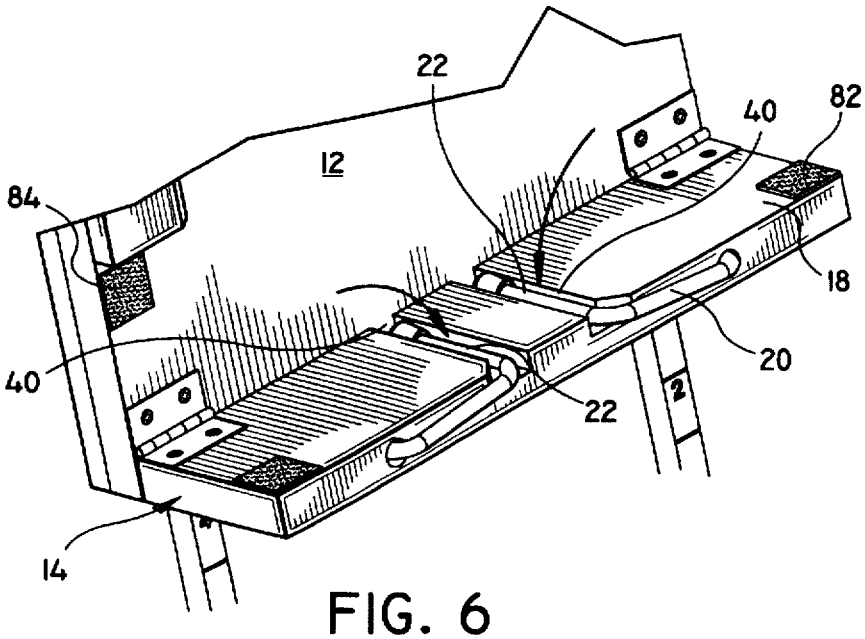
FIG. 6 is a partial perspective view illustrating movement of the lower article clamps to a closed position in superposed relation with the base member.

With reference now to FIG. 6, in conjunction with FIG. 4, article clamp 20 is rotatably movable about an axis of rotation extending through mounting segment 24 between an operative position depicted in FIG. 4 and the non-operative position depicted in FIG. 6. In the non-operative position, article clamp 20 is in superposed relation with base member 14. Preferably, base member 14 includes first and second mounting grooves 40 extending through support surface 18 of base member 14 to receive article clamps 20 when in the non-operative position to thereby reduce the overall profile of the folded base member 14.

Referring again to FIGS. 1–3, apparatus 10 further includes an upper article clamp 42 which is configured to releasably engage the upper portion of the reading article "A". Upper article clamp 42 is preferably a conventional spring clamp pivotally movable between the closed position depicted in FIG. 1 and the open position depicted in FIG. 3. Other types of clamps are envisioned as well such as the article clamp 20 described hereinabove. Article clamp 42 is mounted to clamp support plate 44, which is, in turn, slidably mounted to backing member 12. In a preferred arrangement, the edge portions 44a of clamp support plate 44 are received within correspondingly dimensioned longitudinal slots 46 defined between side mounts 48 and the support surface 12*a* of backing member 12. Side mounts 48 may be integrally formed with backing member 12 or may be separate components affixed to the backing member 12 as shown. Clamp support plate 44 is selectively movable in a general vertical direction as indicated by the directional arrow of FIG. 1 to selectively adjust the vertical positioning of article clamp 42, thus, to accommodate books of varying height. As best depicted in FIG. 2, a plurality of wing bolts 50 extend through the rear surface of backing member 12 and engage the rear surface of clamp support plate 44 to positively fix the clamp support plate 44 at a desired vertical position. Wing bolts 50 may be similar in function and structure to those described in connection with lower article clamp 20.

Thus, the movement of clamp support plate 44 relative to backing member 12 enables the user to increase the effective length of backing member 12 so as to provide support for significantly large (in length) books. It is to be noted that clamp support plate 44 may move toward base member 12 to a position whereby lower edge 44*b* (FIG. 1) of clamp support plate 44 engages base member 14 to accomodate books smaller in length.

Figure 7:
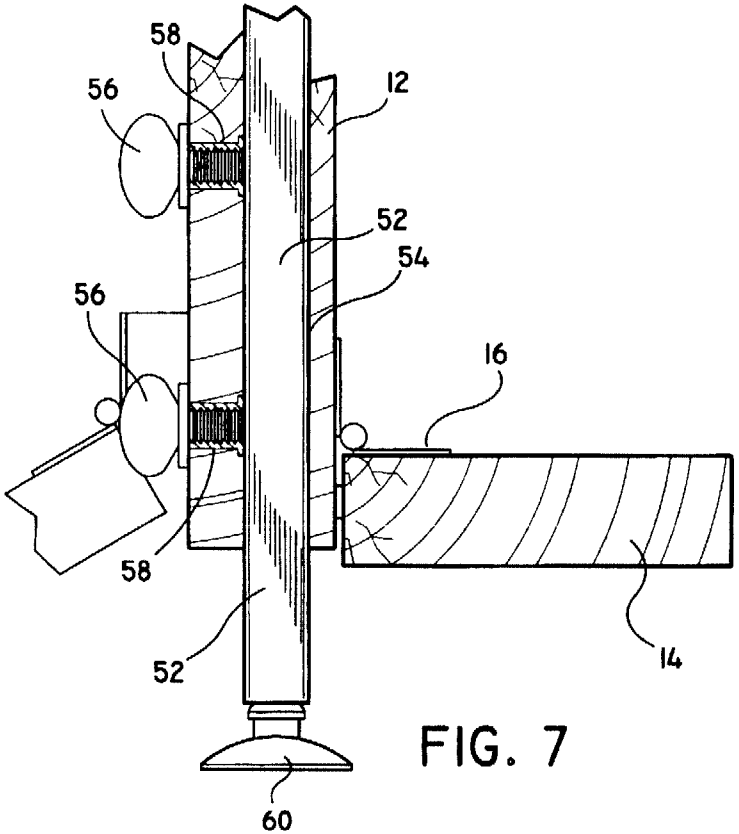
FIG. 7 is a cross-sectional view of a leg member telescopically received within a bore of the backing member to adjust the vertical position of the base member.

Referring now to FIG. 7, in conjunction with FIGS. 1–2, apparatus 10 further includes first and second vertical leg members 52 telescopically received within correspondingly dimensioned bores 54 extending through backing member 12. Leg members 52 are slidably movable within bores 54 to selectively adjust the vertical positioning of base member 14. Accordingly, the vertical location of the reading article "A" may be selectively adjusted to ensure the article "A" is at a proper reading level to minimize forward flexion of the head. As depicted in FIG. 2, a plurality (two are shown) of wing bolts 56 extend from the rear through threaded bore 58 of backing member 12 to engage vertical leg members 52 to secure the vertical leg members 52 at any desired position. Leg members 52 may have suction cups 60 at their remote ends to enhance engagement with the table top.

Figure 8:
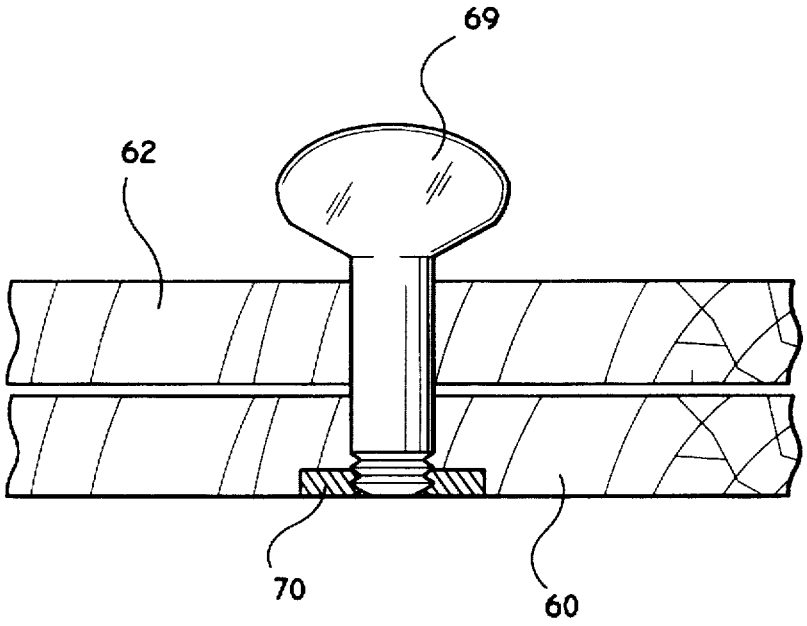
FIG. 8 is a cross-sectional view taken along the lines 8—8 of FIG. 2 illustrating the locking mechanism for securing the relative positioning of the first and second brace members.

With continued reference to FIG. 2, in conjunction with FIG. 8 which is a cross-sectional view taken along the lines 8—8 of FIG. 2, apparatus 10 further includes first and second brace members 62, 64 which permit adjustment of the angular orientation of backing member 12. First brace member 62 is pivotally connected to the upper portion of backing member 12 through hinge joint 66. Second brace member 64 is slidably mounted to first brace member 62 via a pin and slot arrangement. In particular, each brace member 62, 64 includes a longitudinal slot 68 in general alignment with the respective slot of the other brace member. A pair of mounting wing bolts 69 extend through the corresponding slots 66. Preferably, first brace member 62 has locking nuts 70 (FIG. 8) which threadably engage mounting bolts 69 to thereby secure the brace members 62, 64 at a plurality of relative positions. Second brace member 64 is slidably movable relative to first brace member 62 to adjust the overall effective length of the brace members 62, 64, the significance of which will be appreciated from the description provided hereinbelow.

With particular reference to FIG. 2, a locking brace 72 is pivotably connected to the lower rear surface of backing member 12 through hinge joint 74. Locking brace 72 is advantageously configured to be engaged by the first and second brace member 62, 64 arrangement to maintain the first and second brace members 62, 64 at a desired angular orientation with respect to the backing member 12. Accordingly, the angular orientation of backing member 12 may be adjusted to selectively orient the angular orientation relative to the vertical of the reading article "A". Locking brace 72 includes a plurality of transverse slots 74 which receive the lower edge 64*a* of second brace member 64 to maintain the first and second brace arrangement 62, 64 at a desired orientation, i.e. to position the backing member 12 towards a more vertical orientation, lower edge 64*a* is positioned in one of the slots 74 proximate backing member 12. To position backing member 12 at a more inclined orientation, lower edge 64*a* of second brace member 64 is positioned in one of the slots 74 remote to backing panel 12.

It is to be appreciated that the overall effective length of the first and second brace arrangement 62, 64 may also be adjusted to control the angular orientation of backing member 12, i.e. the effective length may be increased which would position the backing member 12 in a more vertical position. Alternatively, the effective length may be decreased which would position the backing member 12 at a more inclined position. It is also envisioned that locking brace 72 may be removed whereby the lower edge 64*a* of second brace member 64 would contact the desktop or table with the angular orientation of backing member 12 adjusted solely through the changing of the effective length of the brace members 62, 64 in the manner discussed above. With this arrangement, a rubber surface may be adhered to the lower edge 64*a* of second brace member 64 to facilitate engagement with the table surface. Alternatively, a suction cup such as that described in connection with leg members 52 may be utilized to engage the table top.

Figure 11:
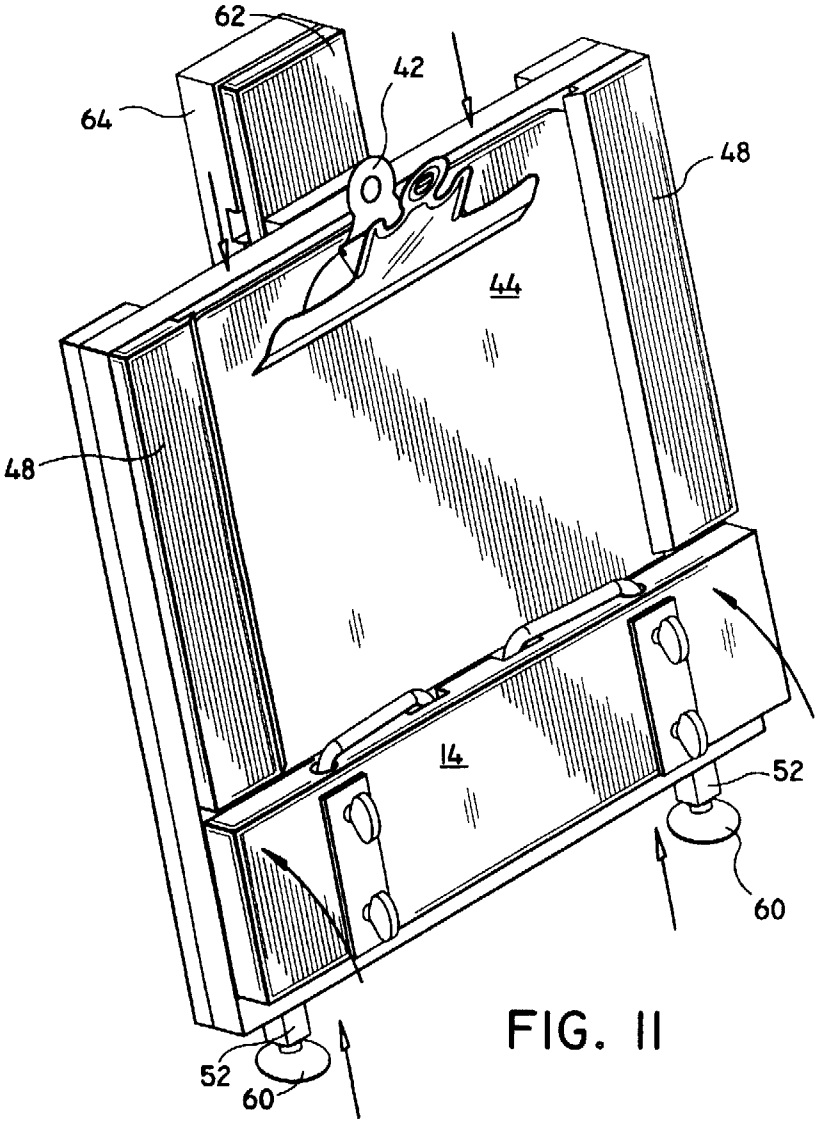
FIG. 11 is a frontal perspective view illustrating folding of the base member in superposed relation relative to the backing member.
Figure 10:
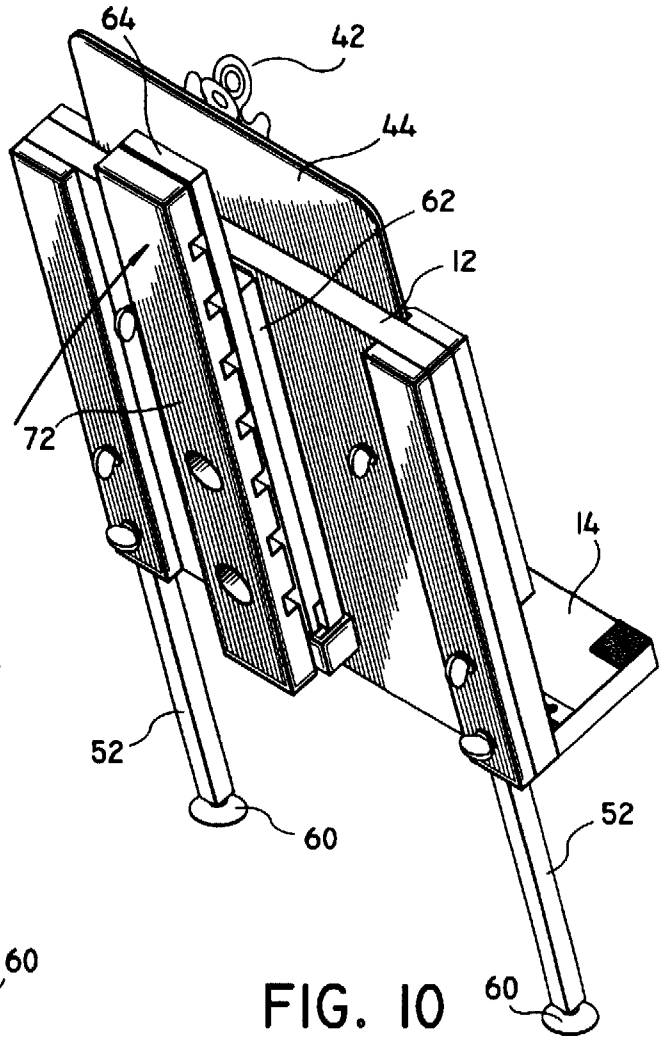
FIG. 10 is a view similar to the view of FIG. 9 illustrating the locking member folded onto the brace members in accordance with the preferred sequence.
Figure 9:
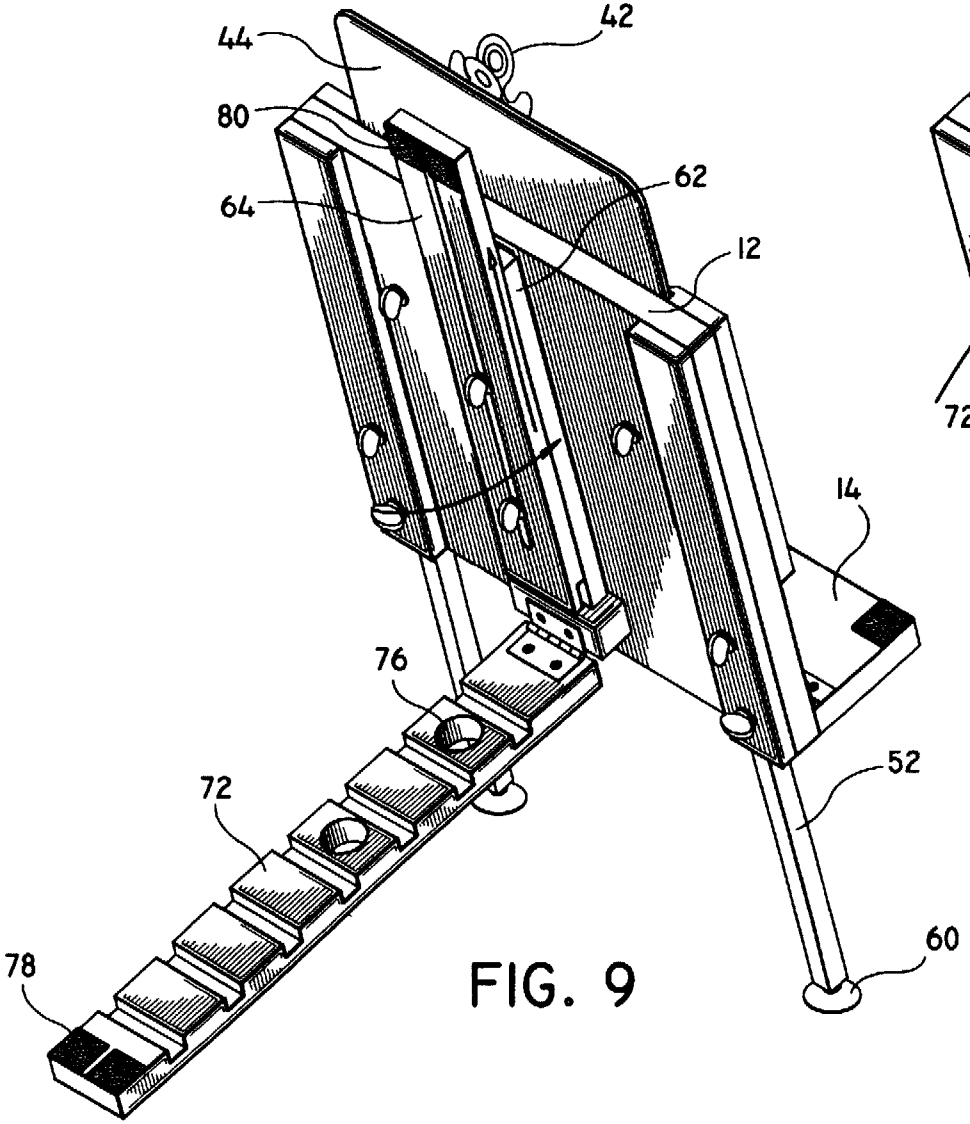
FIG. 9 is a rear perspective view illustrating folding of the brace members in accordance with a preferred sequence of folding the apparatus.

Referring now to FIGS. 9–11, collapsing of the apparatus to facilitate transport will be discussed. Initially, first and second brace members 62, 64 are disengaged from locking brace 72. Second brace member 64 is then moved relative to first brace member 62 such that the lower edges of the brace members 62, 64 are in general alignment. Thereafter, the brace members 62, 64 are pivoted along hinge 66 such that they are positioned flat against the rear of backing member 12. Locking brace 72 is pivoted upwardly against brace members 62, 64 as depicted in FIG. 10. Preferably, locking brace 72 includes two apertures 76 formed therein to receive wing bolts 68 to ensure that the locking brace 72 lies flat against second brace member 62. Locking brace 72 has a Velcro™ strip 78 which engages Velcro™ strip 80 on second brace member 64 to retain the locking brace 72 in the secured position. Other means for retaining locking brace 72 in the secured position are envisioned as well including locking hooks, tabs, etc. . . .

With reference now to FIG. 11, leg members 52 are moved upwardly by disengaging wing bolts 56 and advancing the leg members 52 within bores 54 of backing member 12. Wing bolts 56 may then be tightened to ensure that the leg members 52 are secured in this position. Base member 14 is then pivoted upwardly along hinges 16 to the superposed position with respect to backing member shown in FIG. 11. Velcro strips 82, 84 (FIG. 1) disposed on base member 14 and backing member 12, respectively, may be utilized to maintain the base member 14 in the secured position.

Thus, the apparatus of the present invention can support a reading article in a sturdy upright position and is readily adjustable to ensure a proper line of sight regardless of the reader's position or location of the table top. The apparatus can be collapsed to facilitate transport and storage. Preferably, the structural components are fabricated from a polymeric material through injection molding techniques although it is envisioned that wood or stainless steel may be used as well.

While the above description contains many specifics, these specifics should not be construed as limitations on the scope of the invention, but merely as an exemplification of a preferred embodiment thereof. Those skilled in the art will envision other possible variations that are within the scope and spirit of the invention as defined by the claims appended hereto.

What is claimed is:

1. An apparatus for supporting a reading article in an open position, which comprises:

a base member having a base supporting surface for supporting a reading article along a lower edge of the reading article when in an open position of the reading article, said supporting surface appropriately dimensioned to accommodate reading articles of varying sizes;

a backing member operatively connected to said base member and extending at least in a vertical direction relative to said base member, said backing member having a backing support surface for supporting the reading article;

at least one leg member telescopically received within a correspondingly dimensioned bore of said backing member, said one leg member movable within said bore relative to said backing member to selectively adjust at least the vertical positioning of said base member to thereby at least adjust the position of the reading article: and said base member being foldable to a closed position thereof to be in superposed relation with respect to said backing member.

2. The apparatus according to claim 1, wherein said base member is connected to said backing member through at least one hinge, said base member being foldable along said one hinge.

3. The apparatus according to claim 1 including means for releasably securing said one leg member at a plurality of predetermined positions with respect to said base member.

4. The apparatus according to claim 1 including at least one brace member connected to said backing member, said one brace member movable to selectively adjust the angular orientation of said backing member.

5. The apparatus according to claim 4 including a locking brace connected to one of said base member and said backing member, said one brace member engagable with said locking brace to selectively position said backing member at a plurality of angular orientations.

6. The apparatus according to claim 5 wherein said locking brace is connected to said backing member through a hinge, said brace member being foldable along said hinge to a superposed position with respect to said backing member.

7. The apparatus according to claim 4 wherein said one brace member is connected to said backing member through a hinge, said brace member being foldable along said hinge to a superposed position with respect to said backing member.

8. The apparatus according to claim 1 including at least one lower article clamp associated with said base member, said one article clamp moveable in a lateral direction with respect to said backing member to releasably engage a lower portion of the reading article.

9. The apparatus according to claim 8 wherein said one lower article clamp is rotatable about an axis of rotation to assume a closed position in general superposed relation with respect to said base member.

10. The apparatus according to claim 1 including an upper article clamp associated with said backing member, said upper article clamp dimensioned and configured to releasably engage an upper portion of the reading article.

11. The apparatus according to claim 10 wherein at least the vertical positioning of said upper article clamp is adjustable relative to said backing member to accommodate reading articles of varying heights.

12. An apparatus for supporting a reading article in an opened position, which comprises:

a base member having a base supporting surface for supporting a reading article along a lower edge of the reading article when in an open position of the reading article;

a backing member operatively connected to said base member and extending at least in a vertical direction relative to said base member, said backing member having a backing support surface for supporting the reading article; and at least one leg member at least partially received within a correspondingly dimensioned bore of said backing member, said one leg member selectively movable within said bore to at least adjust the vertical positioning of said base member to thereby at least adjust the vertical positioning of the reading article.

13. An apparatus for supporting a reading article in an open position, which comprises:

a base member having a base supporting surface for supporting a reading article along a lower edge of the reading article when in an open position of the reading article, said supporting surface appropriately dimensioned to accommodate reading articles of varying sizes;

a backing member operatively connected to said base member and extending at least in a vertical direction relative to said base member, said backing member having a backing support surface for supporting the reading article;

at least one lower article clam associated with said base member, said one article clamp moveable in a lateral direction with respect to said backing member to releasably engage a lower portion of the reading article;

a locking member for securing said one article clamp at a plurality of predetermined lateral positions.

14. The apparatus according to claim 13 including first and second lower article clamps.

15. An apparatus for supporting a reading article in an open position, which comprises:

a base member having a base supporting surface for supporting a reading article along a lower edge of the reading article when in an open position of the reading article, said supporting surface appropriately dimensioned to accommodate reading articles of varying sizes;

a backing member operatively connected to said base member and extending at least in a vertical direction relative to said base member, said backing member having a backing support surface for supporting the reading article; and at least one lower article clamp associated with said base member, said one article clamp moveable in a lateral direction with respect to said backing member to releasably engage a lower portion of the reading article, said one article clamp being laterally biased toward said backing member by a resilient member.

16. An apparatus for supporting a reading article in an open position, which comprises:

a base member having a base supporting surface for supporting a reading article along a lower edge of the reading article when in an open position, said supporting surface appropriately dimensioned to accommodate reading articles of varying sizes;

a backing member operatively connected to said base member and extending at least in a vertical direction relative to said base member, said backing member having a backing support surface for supporting the reading article;

at least two brace members dimensioned for supporting said backing member at a plurality of predetermined angular positions, a first of said brace members connected to said backing member, a second of said brace members operatively connected to said first brace member, said first and second brace members adapted for relative movement to control the effective length of said first and second brace members, to thereby selectively position said backing member at one of said predetermined angular positions.

17. The apparatus according to claim 16 including a locking member associated with said first and second brace members, said locking member movable to secure said first and second brace members at a desired relative position.

18. The apparatus according to claim 16 including a locking brace connected to one of said base member and said backing member, said locking brace engagable with said second brace member to selectively secure said backing member at said one of said predetermined angular positions.

19. The apparatus according to claim 18 wherein said first brace member is connected to said backing member through a hinge, said first brace member being foldable along said hinge to a superposed position with respect to said backing member.

20. The apparatus according to claim 19 wherein said locking brace is connected to said backing member through a hinge, said locking brace member being foldable along said hinge to a superposed position with respect to said backing member.

21. The apparatus according to claim 19 wherein said locking brace includes a plurality of spaced grooves dimensioned to receive an end portion of said brace member.

22. An apparatus for supporting a reading article in an opened position, which comprises:

a base member having a base supporting surface for supporting a reading article along a lower edge of the reading article when in an open position;

a backing member operatively connected to said base member and extending at least in a vertical direction relative to said base member, said backing member having a backing support surface for supporting the reading article;

an upper article clamp associated with said backing member, said upper article clamp to releasably engage an upper portion of the reading article; and at least the vertical positioning of said upper article clamp being adjustable to accommodate reading articles of varying heights.

23. The apparatus according to claim 22 wherein said upper article clamp is mounted on an article support plate, said article support plate movably mounted to said backing member to at least adjust the vertical positioning of said upper article clamp.

24. The apparatus according to claim 22 including a locking member operatively engageable with said upper article clamp and movable to secure said upper article clamp at a desired vertical position.

25. An apparatus for supporting a reading article in an open position, which comprises:

a base member having a base supporting surface for supporting a reading article along a lower edge of the reading article when in an open position of the reading article, said supporting surface appropriately dimensioned to accommodate reading articles of varying sizes;

a backing member operatively connected to said base member and extending at least in a vertical direction relative to said base member, said backing member having a backing support surface for supporting the reading article;

at least one leg member associated with one of said base member and said backing member, said one leg member selectively adjustable to at least adjust the vertical positioning of said base member to thereby at least adjust the position of the reading article;

an upper article clamp associated with said backing member, said upper article clamp dimensioned to releasably engage an upper portion of the reading article;

at least one lower article clamp associated with said base member, said one article clamp dimensioned and arranged to releasably engage a lower portion of the reading article;

at least one brace member operatively connected to said backing member, said one brace member movable to selectively adjust the angular orientation of said backing member; and a locking brace operatively connected to one of said base member and said backing member, said one brace member engagable with said locking brace to selectively secure said backing member at a plurality of angular orientations.

26. The apparatus according to claim 25 wherein said base member is pivotally connected to said backing member, said base member being adapted to pivot to a closed position thereof in superposed relation with respect to said backing member.

27. The apparatus according to claim 26 wherein said locking brace is pivotally connected to said one of said base member and said backing member, said locking brace adapted to pivot to a superposed position with respect to said backing member.

28. The apparatus according to claim 27 wherein said one brace member is pivotally connected to said backing member, said one brace member adapted to pivot to a superposed position with respect to said backing member.

* * * * *